US008534803B2

(12) United States Patent
Makishima

(10) Patent No.: US 8,534,803 B2
(45) Date of Patent: Sep. 17, 2013

(54) LIQUID JET HEAD CHIP, MANUFACTURING METHOD THEREFOR, LIQUID JET HEAD, AND LIQUID JET RECORDING APPARATUS

(75) Inventor: Tomiharu Makishima, Chiba (JP)

(73) Assignee: SII Printek Inc. (JP)

( * ) Notice: Subject to any disclaimer, the term of this patent is extended or adjusted under 35 U.S.C. 154(b) by 238 days.

(21) Appl. No.: 12/655,625

(22) Filed: Jan. 4, 2010

(65) Prior Publication Data

US 2010/0177133 A1 Jul. 15, 2010

(30) Foreign Application Priority Data

Jan. 9, 2009 (JP) ..... 2009-003611

(51) Int. Cl.
*B41J 2/045* (2006.01)

(52) U.S. Cl.
USPC ..... 347/68; 347/11; 347/69

(58) Field of Classification Search
USPC ..... 347/10, 63, 68, 69, 40, 5, 9, 11
See application file for complete search history.

(56) References Cited

U.S. PATENT DOCUMENTS 5,016,028 A * 5/1991 Temple ..... 347/69
5,363,133 A * 11/1994 Sugahara et al. ..... 347/69
5,959,643 A * 9/1999 Temple et al. ..... 347/40
7,195,327 B2 * 3/2007 Kitami et al. ..... 347/11
2002/0005880 A1 1/2002 Ashe et al. ..... 347/68
2008/0266338 A1 10/2008 Koseki et al. ..... 347/10

FOREIGN PATENT DOCUMENTS

JP 07304169 11/1995

OTHER PUBLICATIONS

British IPO Search Report mailed Apr. 12, 2013 issued in GB Appln. No. GB1000314.3.
British IPO Examination Report mailed Apr. 12, 2013 issued in GB Appln. No. GB1000314.3.

* cited by examiner

*Primary Examiner* — Lam S Nguyen
(74) *Attorney, Agent, or Firm* — Adams & Wilks

(57) ABSTRACT

A liquid jet head chip has a jet plate with jet holes for jetting liquid. A piezoelectric actuator has first and second actuator plates superimposed over one another to form channels communicating with the jet holes. The first actuator plate has first partitions spaced apart from one another to form first groove portions and has first electrodes each disposed on only a portion of a side surface of a respective one of the first partitions. The second actuator plate has second partitions spaced apart from one another to form second groove portions and has second electrodes each disposed on only a portion of a side surface of a respective one of the second partitions. The first partitions of the first actuator plate extend into respective second groove portions of the second actuator plate, and the second partitions of the second actuator plate extend into respective first groove portions of the first actuator plate to form the channels communicating with the jet holes.

25 Claims, 10 Drawing Sheets

LIQUID JET HEAD CHIP, MANUFACTURING METHOD THEREFOR, LIQUID JET HEAD, AND LIQUID JET RECORDING APPARATUS

BACKGROUND OF THE INVENTION

1. Field of the Invention

The present invention relates to a liquid jet head chip, a manufacturing method therefor, a liquid jet head, and a liquid jet recording apparatus having the liquid jet head.

2. Description of the Related Art

Conventionally, there is used an inkjet recording apparatus (liquid jet recording apparatus), which jets liquid, e.g., ink from nozzle holes (liquid jet holes) of a head chip (liquid jet head chip) so that ink drops are placed on a recording medium, to thereby print characters, images or the like. Each of the nozzle holes of the head chip is coupled to a piezoelectric actuator (liquid feeding portion). The piezoelectric actuator is provided with a plurality of groove portions (channels) in which the ink is filled. When a drive electrode that is provided to a partition for parting the groove portion is energized, the partition is deformed to squeeze out the ink so that the ink drop jets out from the nozzle hole, to thereby perform printing on the recording medium.

Here, it is common to use a diamond blade called "dicer" for grinding an actuator plate so as to form the groove portion of the piezoelectric actuator in a dicing step (see, for example, Japanese Patent Application Laid-open No. Hei 05-269995 and Japanese Patent Application Laid-open No. 2005-271305). For instance, as described in Japanese Patent Application Laid-open No. Hei 05-269995, the groove portion of the piezoelectric actuator formed by grinding with the dicer has a width of approximately 60 to 86 μm.

Recently, the liquid jet recording apparatus such as the inkjet recording apparatus described above is required to improve resolution of characters and symbols printed on the recording medium so that higher resolution (higher definition) is achieved.

Here, in order to increase resolution of the inkjet recording apparatus, it is conceivable, for example, to decrease a pitch of the groove portions of the piezoelectric actuator. In order to decrease a pitch of the groove portion, it is conceivable to use a dicer that is as thin (small width) as possible to grind the actuator plate.

However, the thickness (width) of the dicer to be used in the dicing process has a limitation for securing strength or the like of the dicer, and hence there is a limitation in decreasing a pitch of the groove portion.

In addition, it is also conceivable to decrease a width of the partition in order to decrease a pitch of the groove portion.

However, if the width of the partition is decreased, the partition may be broken. In order to decrease the width of the partition, high accuracy of machining is required, which causes difficulty in machining. As a result, yield cannot be improved, and there may be a case where the machining cannot be performed.

Thus, it is difficult to decrease a pitch of the groove portion further in the future.

SUMMARY OF THE INVENTION

The present invention is created in view of the above-mentioned situation, and it is an object of the present invention to provide a liquid jet head chip in which easiness in machining is improved and a narrow pitch of channels and high resolution are realized, and to a manufacturing method for the liquid head chip, a liquid jet head having the liquid head chip, and a liquid jet recording apparatus having the liquid jet head.

In order to solve the above-mentioned problems, the present invention provides the following means.

A liquid jet head chip according to the present invention includes: a jet plate in which a plurality of jet holes for jetting liquid are formed; and a liquid feeding portion having channels communicating to the jet holes so as to supply the liquid from the channels to the jet holes, in which: the liquid feeding portion includes a first actuator plate and a second actuator plate; each of the first actuator plate and the second actuator plate has a plurality of partitions formed with predetermined spaces in an arrangement direction of the jet holes and a groove portion formed between neighboring partitions, the first actuator plate and the second actuator plate are superimposed with each other so that the partition of one of the first actuator plate and the second actuator plate is disposed in the groove portion of another of the first actuator plate and the second actuator plate, and each of the channels is formed between the partition of the first actuator plate and the partition of the second actuator plate.

With this structure, the first actuator plate and the second actuator plate are superimposed with each other so that the partition of the first actuator plate is disposed in the groove portion of the second actuator plate while the partition of the second actuator plate is disposed in the groove portion of the first actuator plate. In other words, the first actuator plate and the second actuator plate are superimposed with each other so that the partitions of the actuator plates are disposed alternately, and hence the partition of one of the first actuator plate and the second actuator plate divides the space in the groove portion of another of the first actuator plate and the second actuator plate into two parts in the width direction. Thus, one groove portion can form two channels, and hence it is possible to form a channel having smaller width than the conventional channel by using existing machining tools and manufacturing method.

Therefore, a small pitch of the channels can be realized while easiness of machining and yield can be improved. Thus, resolution of characters and symbols recorded on the recording medium can be improved so that high resolution can be realized.

Further, the first actuator plate and the second actuator plate are formed to have the same shape.

With this structure, both the first actuator plate and the second actuator plate can be formed to have the same shape, and hence the first actuator plate and the second actuator plate can be manufactured by using the same machining tools and manufacturing method. Thus, easiness of machining can be improved and manufacturing cost can be reduced.

Further, each of the jet holes is formed to have an opening part of an elliptic contour, and is arranged so that a minor axis direction thereof corresponds to a short side direction of each opening part of the channels.

With this structure, the minor axis direction of the jet holes and the short side direction of the channels correspond to each other, and hence the area of the opening can be increased compared with a circular jet holes. Thus, even if the liquid is jetted through a channel having a small width, a jet amount of the liquid can be secured.

Further, a liquid inlet hole communicating to the channels is formed in one of the first actuator plate and the second actuator plate so that the liquid can be supplied to the channels.

With this structure, one of the actuator plates is provided with the liquid inlet hole that can communicate to the channels, and hence the liquid can be filled in the plurality of channels at one time. Thus, the structure can be simplified compared with the case where each channel is provided with a supplying hole for the liquid, for example.

Further, a deep groove portion that is formed deeper than the groove portion is formed in the groove portion of one of the first actuator plate and the second actuator plate on one side in a width direction of the partition of another of the first actuator plate and the second actuator plate, and the liquid inlet hole is formed so as to be able to communicate only to the channel in which the deep groove portion is formed.

With this structure, the plurality of channels obtained by dividing the groove portion work as the discharging channel alternately. Therefore, even if conductive liquid, for example, is used, the drive electrode disposed in the discharging channel and the drive electrode disposed in the dummy channel can be used independently in an electrically separated state without being conducted through the liquid. Therefore, the conductive liquid can be used for recording. Thus, additional values can be enhanced because the conductive liquid can be used without a problem.

In particular, the deep groove portion is further formed in the groove portion of one of the actuator plates on one side in the width direction, and the liquid inlet hole is formed so as to communicate only to the deep groove portion. In this way, the liquid can be filled only in the discharging channel. Thus, it is possible to provide the piezoelectric actuator that can support the conductive liquid without increasing the machining steps. Therefore, manufacturing cost and manufacturing efficiency can be maintained.

Further, a manufacturing method for a liquid jet head chip according to the present invention includes: a jet plate in which a plurality of jet holes for jetting liquid are formed; and a liquid feeding portion having channels communicating to the jet holes so as to supply the liquid from the channels to the jet holes, the liquid feeding portion being constituted by combining a first actuator plate and a second actuator plate, the method comprising: forming a plurality of groove portions that extend in a direction perpendicular to an arrangement direction of the jet holes of the first actuator plate and the second actuator plate, and are arranged with spaces in the arrangement direction of the jet holes of the first actuator plate and the second actuator plate; and superimposing the first actuator plate and the second actuator plate with each other so that the partition of one of the first actuator plate and the second actuator plate is arranged in the groove portion of another of the first actuator plate and the second actuator plate With this structure, the actuator plates are superimposed with each other so that the partitions of the actuator plates are disposed alternately. Thus, the partition of one actuator plate divides the groove portion of the other actuator plate in the width direction into two parts. Therefore, one groove portion can form two channels, and hence it is possible to form a channel having smaller width than the conventional channel by using existing machining tools and manufacturing method.

Therefore, a small pitch of the channels can be realized while easiness of machining is improved. Thus, it is possible to provide the liquid jet head chip that can improve resolution of characters and symbols recorded on the recording medium so that high resolution can be realized.

Further, a liquid jet head according to the present invention includes: the liquid jet head chip according to the present invention described above; a supply unit for supplying a predetermined amount of the liquid to the liquid inlet hole; and a control unit for applying a drive voltage to a drive electrode.

With this structure, the supply unit supplies a predetermined amount of liquid securely to the liquid inlet hole of the liquid jet head chip. Further, the control unit applies the drive voltage appropriately to the drive electrode, and hence the liquid is jet through the jet hole, to thereby perform recording as described above.

In particular, there is provided a high quality liquid jet head chip with channels of a narrow pitch, and hence recording can be performed securely, and hence quality of the liquid jet head itself can be increased.

Further, a liquid jet recording apparatus according to the present invention includes: the liquid jet head according to the present invention described above; a conveying unit for conveying a recording medium in a predetermined direction; and a moving unit for moving the liquid jet head in a reciprocating manner in a direction perpendicular to a conveying direction of the recording medium.

With this structure, the conveying unit conveys the recording medium in a predetermined direction while the moving unit moves the liquid jet head in a reciprocating manner in the direction perpendicular to the conveying direction of the recording medium. Thus, the recording can be performed correctly in a desired area on the recording medium. In particular, there is provided a high quality liquid jet head chip with channels of a narrow pitch, and hence quality of the liquid jet recording apparatus itself can be increased similarly.

According to the present invention, the first actuator plate and the second actuator plate are superimposed with each other so that the partition of the first actuator plate is disposed in the groove portion of the second actuator plate while the partition of the second actuator plate is disposed in the groove portion of the first actuator plate. In other words, the first actuator plate and the second actuator plate are superimposed with each other so that the partitions of the actuator plates are disposed alternately, and hence the partition of one actuator plate divides the space in the groove portion of the other actuator plate into two parts in the width direction. Thus, one groove portion can form two channels, and hence it is possible to form a channel having smaller width than the width of the conventional channel by using existing machining tools and manufacturing method.

Therefore, a small pitch of the channels can be realized while easiness of machining is improved. Thus, resolution of characters and symbols recorded on the recording medium can be improved so that high resolution can be realized.

BRIEF DESCRIPTION OF THE DRAWINGS

In the accompanying drawings:

FIG. 6 are plan views of an actuator plate, in which

DETAILED DESCRIPTION OF THE PREFERRED EMBODIMENTS

First Embodiment (Inkjet Printer)

Next, a first embodiment of the present invention is described with reference to the attached drawings. Note that, in this embodiment, an inkjet printer 1 that uses nonconductive oil ink (liquid) W for printing is described as an example of a liquid jet recording apparatus.

Figure 1:
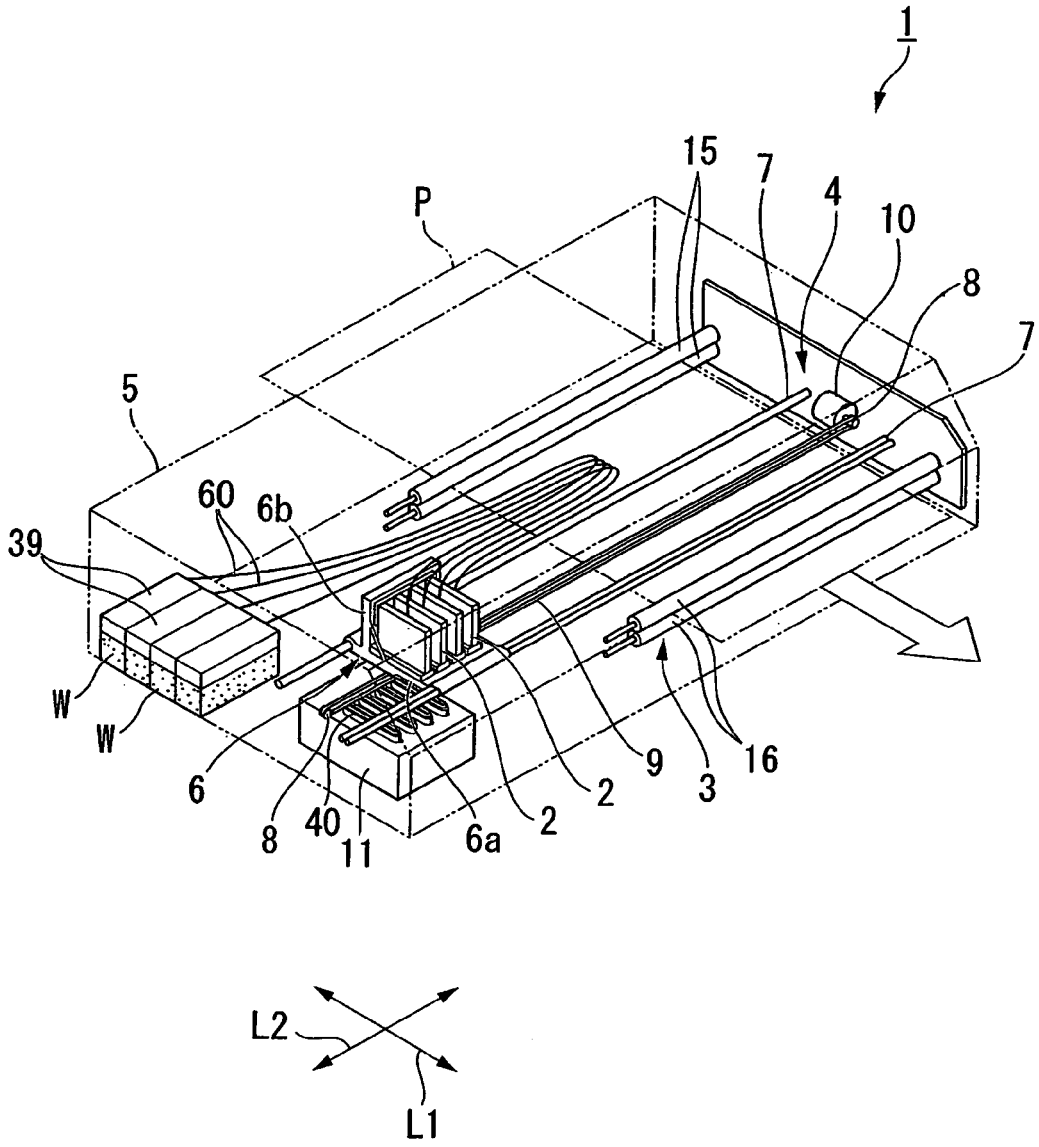
FIG. 1 is a perspective view illustrating a general structure of an inkjet printer according to an embodiment of the present invention.

FIG. 1 is a perspective view illustrating a general structure of the inkjet printer 1.

As illustrated in FIG. 1, the inkjet printer 1 of this embodiment includes a plurality of inkjet heads (liquid jet heads) 2 for jetting ink W, a conveying unit 3 for conveying recording paper (recording medium) P in a predetermined conveying direction L1, and a moving unit 4 for moving the plurality of inkjet heads 2 in a reciprocating manner in the perpendicular direction L2 that is perpendicular to the conveying direction L1.

In other words, the inkjet printer 1 is a so-called shuttle type printer that conveys the recording paper P in the conveying direction L1 while the inkjet head 2 is moved in the perpendicular direction L2 that is perpendicular to the conveying direction L1 for recording characters or images on the recording paper P. Note that this embodiment exemplifies the case where there are disposed four inkjet heads 2 for jetting ink W of different colors (e.g., black, cyan, magenta, and yellow). Note that the four inkjet heads 2 have the same structure.

The four inkjet heads 2 are mounted on a carriage 6 that is housed in a casing 5 having a substantially rectangular solid shape.

The carriage 6, which is constituted of a base 6*a* like a flat plate for supporting the plurality of inkjet heads 2 and a wall portion 6*b* rising vertically from the base 6*a*, is supported by guide rails 7 arranged along the perpendicular direction L2 in a reciprocatingly movable manner. In addition, the carriage 6 is supported by the guide rails 7 and is coupled to a carriage belt 9 that is wound around a pair of pulleys 8. One of the pair of pulleys 8 is coupled to an output shaft of the motor 10, and hence the pulley can rotate receiving a rotation torque from the motor 10. Thus, the carriage 6 can move in a reciprocating manner toward the perpendicular direction L2.

In other words, the pair of guide rails 7, the pair of pulleys 8, the carriage belt 9, and the motor 10 work as the above-mentioned moving unit 4.

In addition, a pair of feed-in rollers 15 and a pair of conveying rollers 16 are disposed in parallel with a space along the perpendicular direction L2 similarly to the pair of guide rails 7 in the casing 5. The pair of feed-in rollers 15 are disposed on the rear side of the casing 5 while the pair of conveying rollers 16 are disposed on the front side of the casing 5. Further, the pair of feed-in rollers 15 and the pair of conveying rollers 16 are adapted to be rotated by a motor (not shown) with the state where the recording paper P is sandwiched between the feed-in rollers 15 and between the conveying rollers 16. Thus, the recording paper P can be conveyed along the conveying direction L1 from the rear side to the front side of the casing 5.

In other words, the pair of feed-in rollers 15 and the pair of conveying rollers 16 work as the above-mentioned conveying unit 3.

(Inkjet Head)

Figure 2:
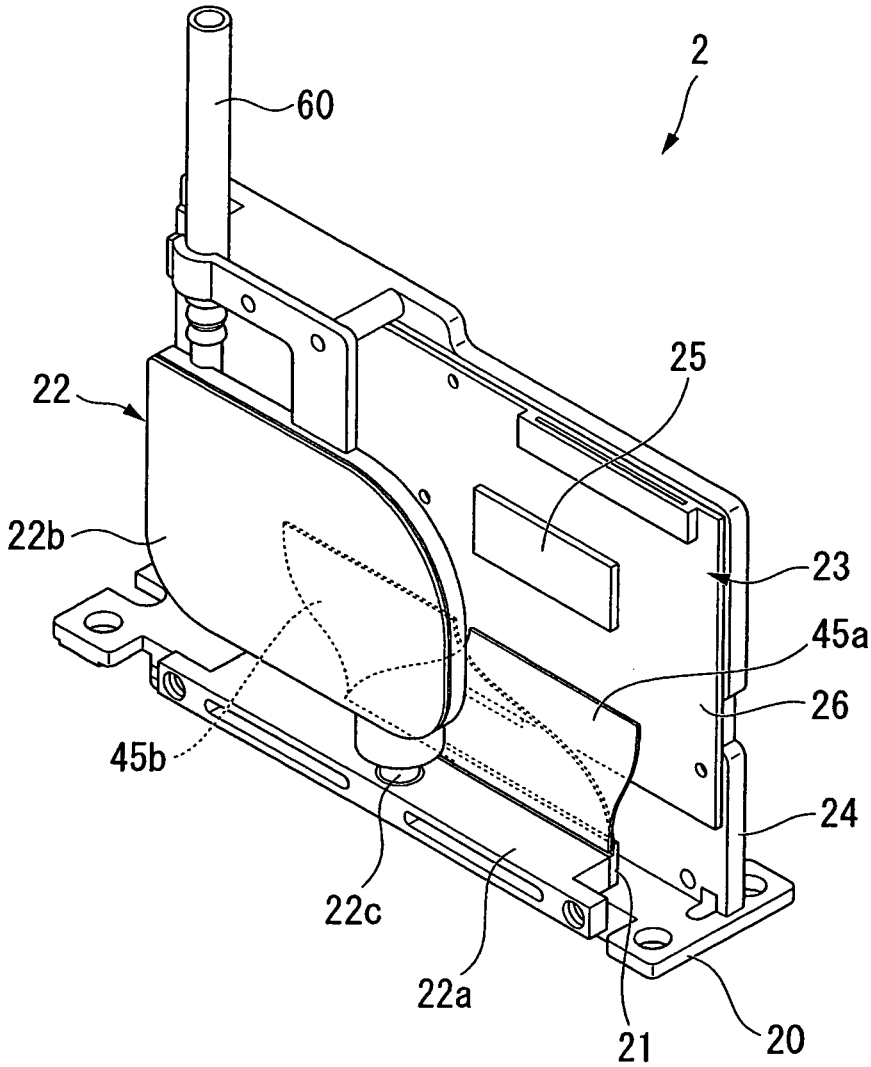
FIG. 2 is a perspective view illustrating an appearance of an inkjet head.

FIG. 2 is a perspective view illustrating an appearance of the inkjet head 2.

As illustrated in FIG. 2, each inkjet head 2 is a so-called shear mode type inkjet head, which includes a rectangular fixing plate 20 that is fixed to the base 6*a* of the carriage 6 with screws (not shown), a head chip 21 fixed to an upper surface of the fixing plate 20, a supply unit 22 for supplying ink W to an ink inlet hole 40 (see FIG. 3) of the head chip 21 to be described later, and a control unit 23 for applying a drive voltage to a drive electrode 37 to be described later.

(Head Chip)

Figure 3:
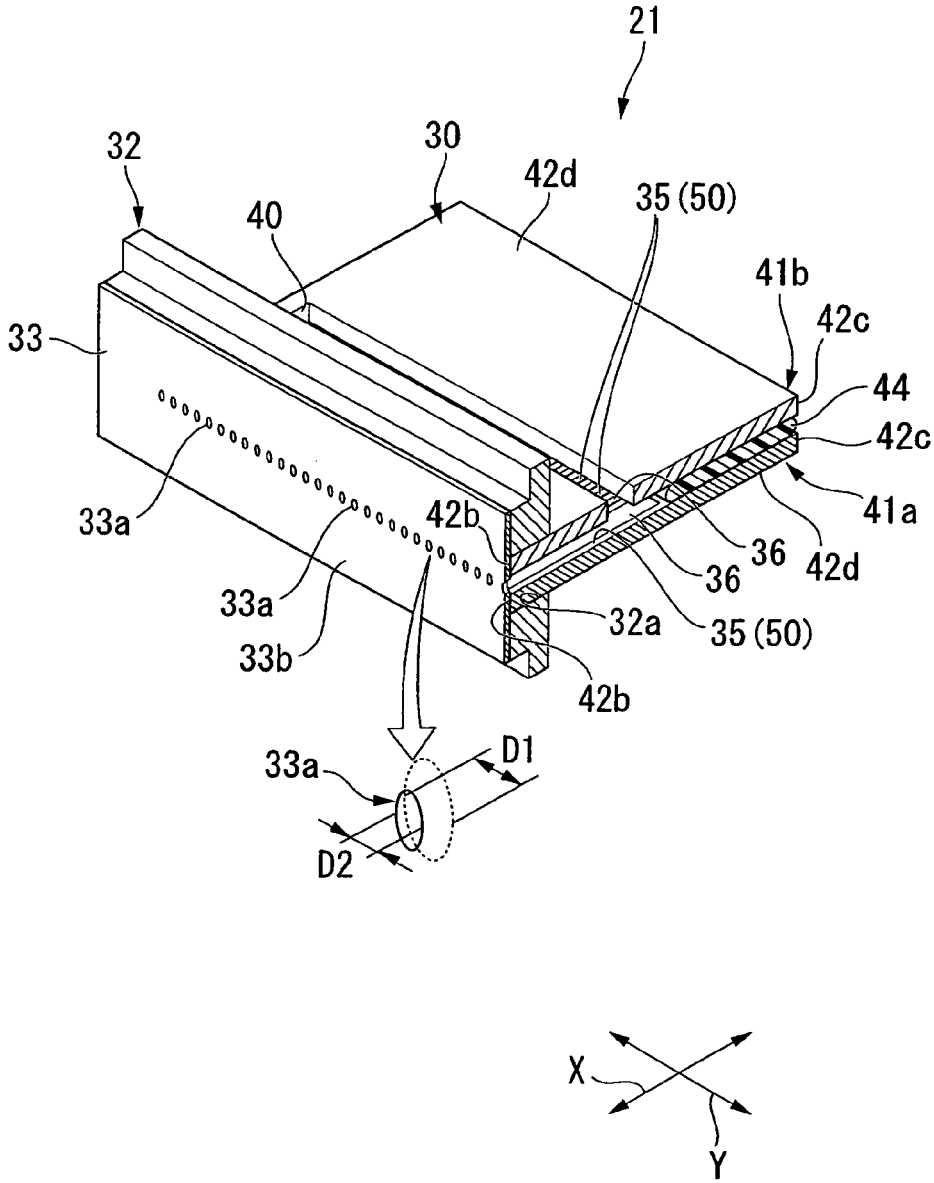
FIG. 3 is a perspective view of a head chip.

FIG. 3 is a perspective view of the head chip 21.

As illustrated in FIG. 3, the head chip 21 is mainly constituted of a piezoelectric actuator (liquid feeding portion) 30, a support plate 32, and a nozzle plate 33 (jet plate).

The support plate 32 supports the piezoelectric actuator 30 as well as the nozzle plate 33. An engaging hole 32*a* is formed in the lateral width direction (Y direction) of the support plate 32, and the piezoelectric actuator 30 is fit in the engaging hole 32*a* so as to be supported. In this case, the support plate 32 and the piezoelectric actuator 30 are combined to each other so that the front end surface of the support plate 32 forms a flat surface with the front end surface of the piezoelectric actuator 30.

Then, the nozzle plate 33 is adhered to the end surface of the support plate 32 and the front end surface of the piezoelectric actuator 30 with an adhesive (not shown).

The nozzle plate 33 is a sheet-like plate made of a film material such as polyimide having a thickness of approximately 50 μm. Further, one surface of the nozzle plate 33 is an adhesive surface that is adhered to the support plate 32 while the other surface is an opposing surface (surface 33*b*) to be opposed to the recording paper P. Note that the surface 33*b* is coated with a water repellent film having water repellency for preventing the ink W from adhering.

In addition, a plurality of nozzle holes (let holes) 33*a* are formed along the lateral width direction (Y direction) of the nozzle plate 33. In this case, the nozzle holes 33*a* are formed at constant intervals substantially linearly along the lateral width direction (Y direction) of the nozzle plate 33.

In addition, each of the nozzle holes 33*a* is formed to have an ellipse contour. For instance, the nozzle hole 33*a* is formed to have a minor axis of approximately 10 μm and a major axis of approximately 53 μm, and a discharging amount of the nozzle hole 33*a* is set to be approximately 30 pico-litters. Further, the inlet diameter D1 (e.g., minor axis of the nozzle hole 33*a*) on the adhesive surface side is larger than the outlet diameter D2 on the surface 33*b* side so that the nozzle hole 33*a* has a tapered cross section. Note that the nozzle holes 33*a* are formed by using an excimer laser apparatus or the like.

As illustrated in FIG. 2, the head chip 21 is fixed to the upper surface of the fixing plate 20 as described above. On the upper surface of the fixing plate 20, the rectangular base plate 24 made of aluminum or the like is fixed so as to rise vertically, and a channel member 22*a* is fixed for supplying ink W to the ink inlet hole 40 of the head chip 21. Above the channel member 22*a*, a pressure buffer 22*b* having a reservoir for reserving the ink W is arranged and supported by the base plate 24. This pressure buffer 22*b* and the channel member 22*a* are connected to each other via an ink connecting tube 22*c*. In addition, a supplying tube 60 for supplying the ink W is disposed above the pressure buffer 22*b*.

In the inkjet head 2 having the structure described above, the ink W is supplied to the pressure buffer 22*b* via the supplying tube 60. Then, the ink W is stored temporarily in the reservoir inside the pressure buffer 22*b*. Further, the pressure buffer 22*b* is adapted to supply a predetermined amount of the ink W out of the stored ink W to the ink inlet hole 40 of the head chip 21 via the ink connecting tube 22*c* and the channel member 22*a*. In other words, the channel member 22*a*, the pressure buffer 22*b* and the ink connecting tube 22*c* work as the supply unit 22 described above.

Figure 4:
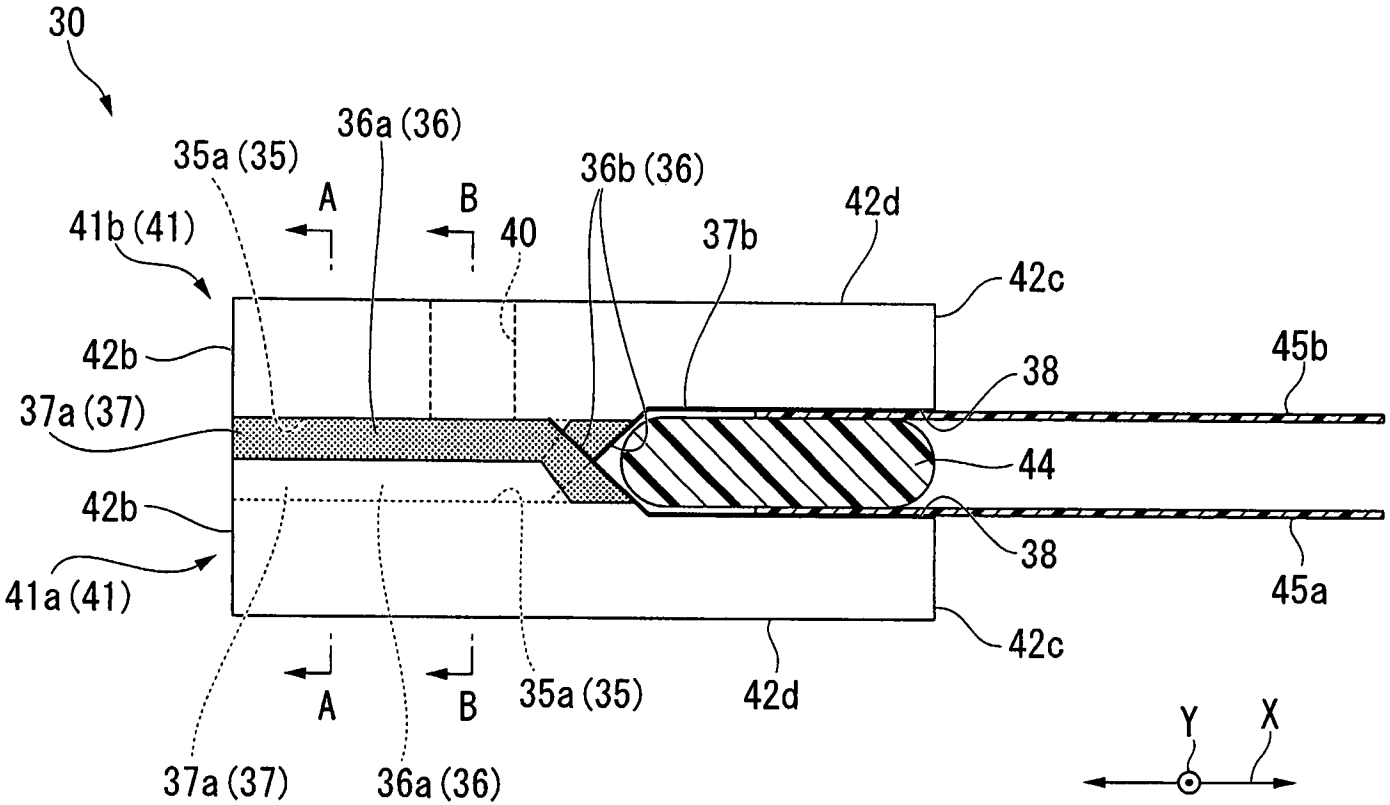
FIG. 4 is a side view of a piezoelectric actuator according to a first embodiment of the present invention.
Figure 5A:
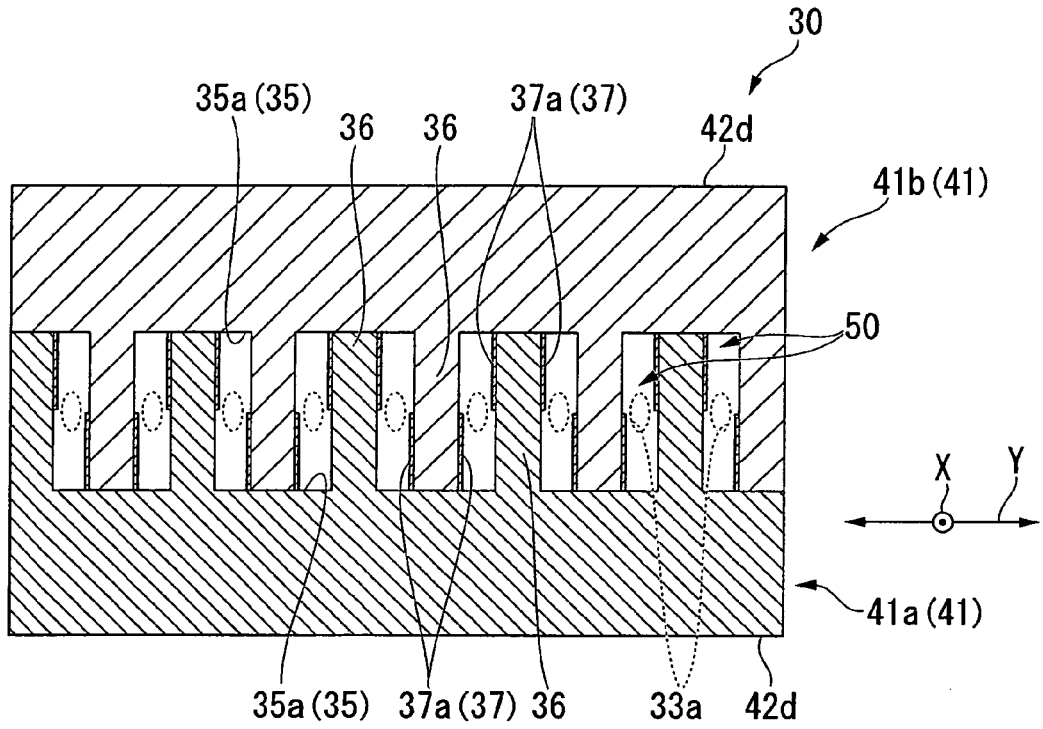
FIG. 5A is a sectional view taken along the line A-A of FIG. 4.
Figure 5B:
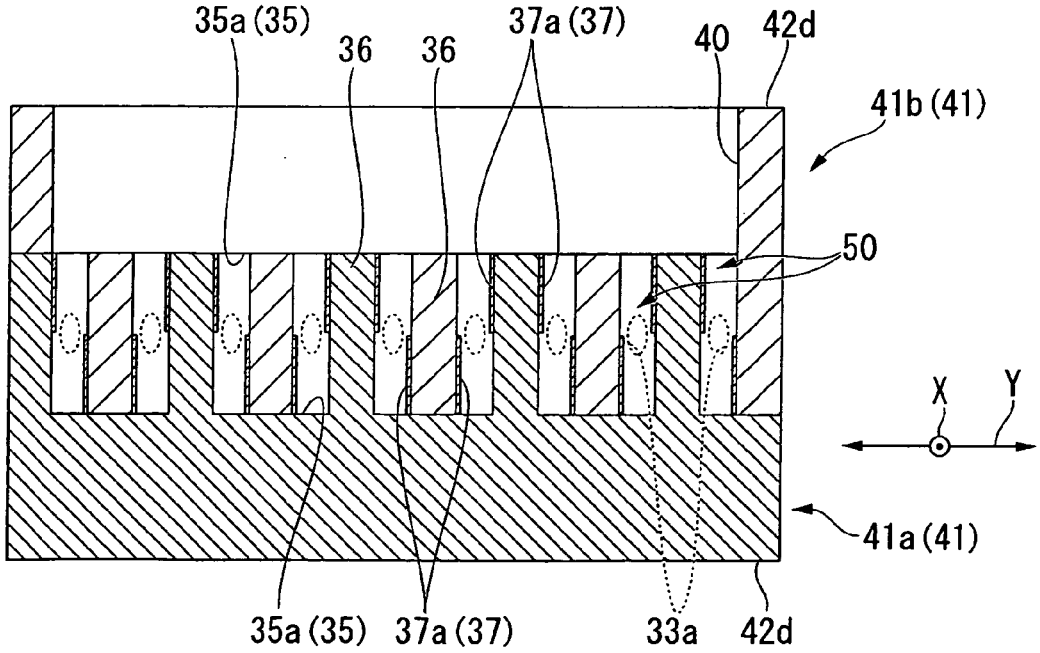
FIG. 5B is a sectional view taken along the line B-B of FIG. 4.

FIG. 4 is a side view of the piezoelectric actuator 30, and FIGS. 5A and 5B are sectional views of the piezoelectric actuator 30, in which FIG. 5A is a sectional view taken along the line A-A of FIG. 4, and FIG. 5B is a sectional view taken along the line B-B of FIG. 4.

Here, as illustrated in FIGS. 3 to 5, the piezoelectric actuator 30 is constituted by superimposing a first actuator plate 41*a* and a second actuator plate 41*b* with each other. Note that the first actuator plate 41*a* and the second actuator plate 41*b* have substantially the same structure, and hence both of them are referred to as an actuator plate 41 except for the case where they should be distinguished from each other in the following description.

Figure 6B:
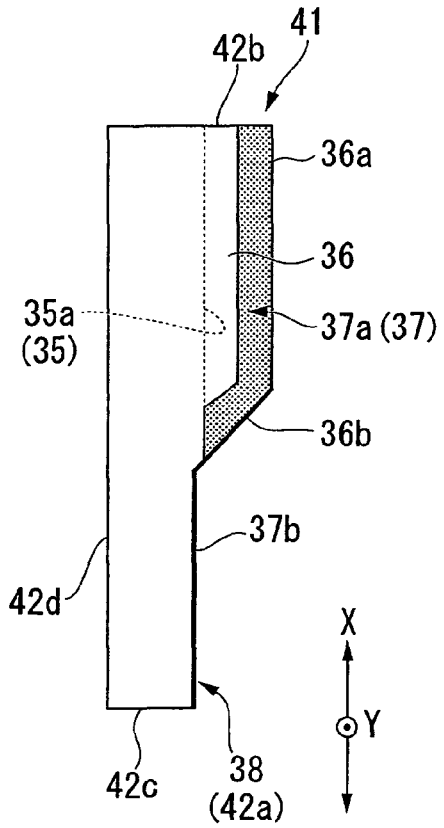
FIG. 6B is a side view.
Figure 6A:
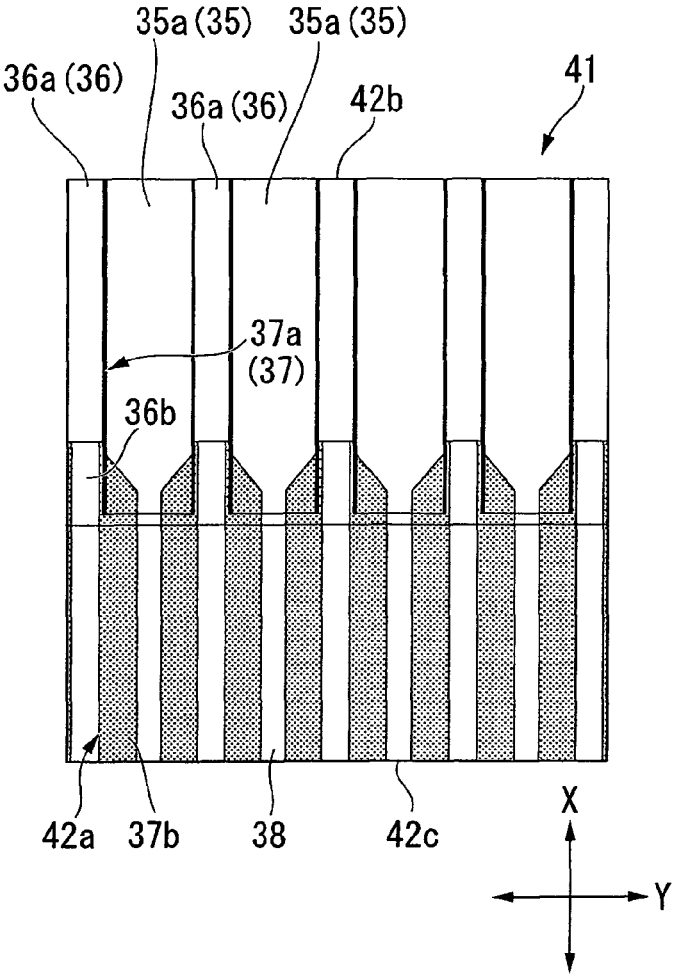
FIG. 6A is an upper view.
Figure 6C:
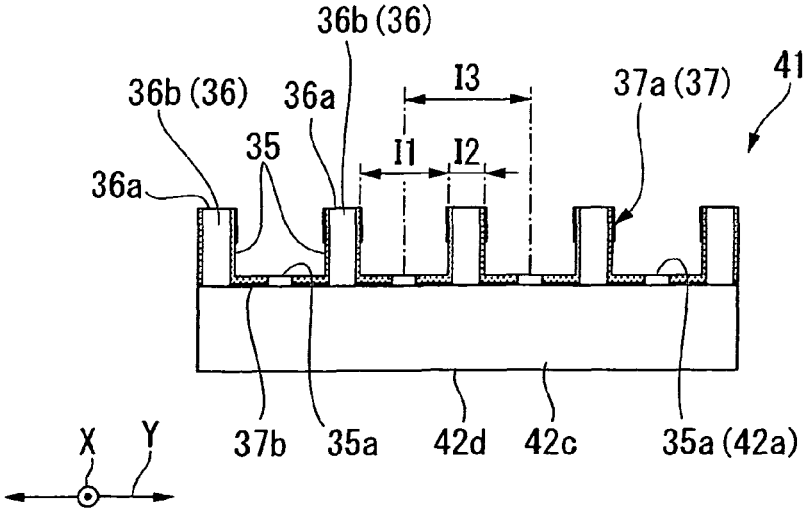
FIG. 6C is a front view thereof.

FIG. 6 are plan views of the actuator plate 41, in which FIG. 6A is an upper view, FIG. 6B is a side view, and FIG. 6C is a front view thereof.

As illustrated in FIGS. 6A to 6C, the actuator plate 41 is a plate made of a piezoelectric material such as lead zirconate titanate (PZT) having the polarization direction set along the thickness direction. On the surface 42*a* side of the actuator plate 41, a plurality of groove portions 35 extending in the length direction (direction of the arrow X) are formed at constant intervals in the lateral width direction (direction of the arrow Y) perpendicular to the length direction. The plurality of groove portions 35 are separated from each other by the partition 36. In this case, the width I1 of the groove portion 35 is larger than the width I2 of a partition 36. For instance, the width I1 of the groove portion 35 is approximately 50 μm, the width I2 of the partition 36 is approximately 20 μm, and the pitch 13 of the groove portion 35 is approximately 70 μm (see FIG. 6C).

Each of the plurality of groove portions 35 works as a discharging channel 50 in which the ink W is filled (see FIGS. 5A and 5B) as described later, and each of the plurality of groove portions 35 is formed to have an opening on each end of the actuator plate 41 in the length direction (X direction).

In addition, the front side of the partition 36 in the length direction (X direction) is constituted of a front extending portion 36*a* extending from the front end surface 42*b* of the actuator plate 41 to substantially the middle portion in the length direction and an inclining portion 36*b* having the decreasing height of the partition 36 from the rear end of the front extending portion 36*a* toward the rear side. In other words, the partition 36 has a trapezoidal shape in the side view (see FIG. 6B), and a plurality of partitions 36 are arranged in the lateral width direction like comb teeth when viewed from the rear end surface 42*c* side of the actuator plate 41 (see FIG. 6C). Further, behind the inclining portion 36*b* of the partition 36, each of the groove portions 35 is opened in the lateral width direction (Y direction) of the actuator plate 41 so as to form a flat surface 38.

The drive electrode 37 made of aluminum, gold, or the like is formed in the length direction on the partition 36 and the flat surface 38 of each of the plurality of groove portions 35 by oblique vapor deposition or the like. The drive electrode 37 includes side face electrodes 37*a* formed on the side surfaces of the partition 36 and flat surface electrodes 37*b* formed on the flat surface 38.

The side face electrode 37*a* is formed along the peripheral portion from the front end side to the rear end side on the side surface of the front extending portion 36*a*, specifically from the upper end of the partition 36 to the middle position thereof in the height direction. In addition, the side face electrode 37*a* is formed along the side surface of the inclining portion 36*b*, and is formed on the rear end side of a bottom surface 35*a* of the groove portion 35 as the inclining portion 36*b* becomes low.

Further, the flat surface electrode 37*b* is formed along the length direction (X direction) on the flat surface 38 in the state of being connected from the rear end side of the groove portion 35 to the side face electrode 37*a*, extending to the rear end surface 42*c* of the actuator plate 41. In other words, each of the drive electrodes 37 is formed from the front end surface 42*b* to the rear end surface 42*c* over the partition 36 and the flat surface 38 in the length direction of the actuator plate 41. In the lateral width direction, the side face electrodes 37*a* are opposed between the partitions 36. The flat surface electrodes 37*b* extend in parallel with a predetermined distance in the lateral width direction on the flat surface 38.

Thus, the flat surface electrodes 37*b* of the drive electrodes 37 are connected electrically to lead electrodes (not shown) of the flexible circuit boards 45*a* and 45*b* (see FIG. 4) described later, and hence the control unit 23 can apply the drive voltage individually. Further, the drive electrode 37 has a role of deforming the partition 36 by piezoelectric thickness sliding effect when the drive voltage is applied.

Here, as illustrated in FIGS. 3 to 5B, the first actuator plate 41*a* and the second actuator plate 41*b* are superimposed so that the surfaces of the plates 41*a* and 41*b* in which the groove portions are formed (surfaces 42*a*) are opposed to each other. Specifically, the partitions 36 of the first actuator plate 41*a* enter the groove portions 35 of the second actuator plate 41*b* respectively while the partitions 36 of the second actuator plate 41*b* enter the groove portions 35 of the first actuator plate 41*a* respectively. In other words, the partitions 36 of the actuator plates 41*a* and 41*b* are arranged alternately, and hence a partition 36 of one actuator plate divides the space in the groove portion 35 of the other actuator plate into two parts in the lateral width direction (Y direction). Further, the actuator plates 41*a* and 41*b* are adhered and fixed to each other with adhesive (not shown) applied between the upper end surfaces of the partitions 36 of one actuator plate (e.g., first actuator plate 41*a*) and the bottom surfaces 35*a* of the groove portions 35 of the other actuator plate (e.g., second actuator plate 41*b*). Note that the adhesive to be used in this case is preferably an epoxy adhesive.

Each of the groove portions 35 divided by the partition 36 into two parts works as the discharging channel 50 in which the ink W is filled. In this case, the width of the discharging channel 50 is approximately 15 μm, and the pitch of the discharging channel 50 is approximately 35 μm. The pitch of the plurality of nozzle holes 33*a* of the nozzle plate 33 described above is also the same value. Note that the nozzle holes 33*a* are arranged so that the minor axis direction of the nozzle hole 33*a* corresponds to the width direction of the discharging channel 50, and that the center thereof is positioned on the center line of each discharging channel 50 in the lateral width direction.

Note that the side face electrodes 37*a* of the actuator plates 41*a* and 41*b* are formed in the peripheral portion of the partition 36. Therefore, when the actuator plates 41*a* and 41*b* are superimposed with each other, the side face electrodes 37*a* in each discharging channel 50 are arranged to be shifted from each other in the vertical direction (in the state not being opposed to each other). However, the side face electrodes 37*a* to be a pair for deforming the partition 36 are the side face electrodes 37*a* that are formed on the same partition 36, and hence there is no problem for driving.

In addition, the second actuator plate 41*b* is provided with the ink inlet hole 40 that is formed to communicate between the back surface 42*d* thereof and the bottom surface 35*a* of the groove portion 35. The ink inlet hole 40 is a through hole formed in the lateral width direction of the second actuator plate 41*b* and having a rectangular shape in the plan view, and is formed in the region where the front extending portion 36*a* is formed in the length direction. In other words, the ink inlet hole 40 can communicate with the individual discharging channels 50, and hence the ink W can be filled in the plurality of discharging channels 50 at one time. Thus, the structure can be simplified compared with the structure in which a supplying hole for the ink W is provided to each of the discharging channels 50.

In addition, as illustrated in FIG. 2, an IC substrate 26 is fixed to the piezoelectric actuator 30, and the driving circuit 25 such as an integrated circuit for driving the head chip 21 is mounted on the IC substrate 26. The driving circuit 25 and the drive electrodes 37 of the actuator plates 41*a* and 41*b* are electrically connected to each other via the first and second flexible circuit boards 45*a* and 45*b*. Specifically, one end of the first flexible circuit board 45*a* is connected to the driving circuit 25 via a wiring pattern (not shown) on the IC substrate 26 at one side, and the other end thereof is led to the flat surface 38 of the first actuator plate 41*a* and is connected to the flat surface electrode 37*b* of the drive electrode 37 formed on the flat surface 38.

On the other hand, one end of the second flexible circuit board 45*b* is connected to the driving circuit 25 via a wiring pattern (not shown) on the IC substrate 26 at the other side, and the other end thereof is led to the flat surface 38 of the second actuator plate 41*b* and is connected to the flat surface electrode 37*b* of the drive electrode 37 formed on the flat surface 38. In other words, connecting portions of the first flexible circuit board 45*a* and the second flexible circuit board 45*b* on one end are shifted from each other in the width direction of the IC substrate 26 and are connected with each other. Note that the second flexible circuit board 45*b* is a so-called inverted flexible circuit board in which the contact portion (not shown) with the driving circuit 25 is formed on one surface and the contact portion (not shown) with the flat surface electrode 37*b* is formed on the other surface.

The driving circuit 25 applies the drive voltage to the drive electrodes 37 via the individual flexible circuit boards 45*a* and 45*b* for jetting the ink W. In other words, the driving circuit 25 and the flexible circuit board 45 work as the above-mentioned control unit 23.

Then, as illustrated in FIG. 4, sealing compound 44 is filled between the flat surfaces 38 of the actuator plates 41*a* and 41*b* on the rear side of the piezoelectric actuator 30. The sealing compound is filled in the lateral width direction of the actuator plates 41*a* and 41*b* so as to prevent the ink W from leaking from the rear end side of the piezoelectric actuator 30 and to secure insulation between the flexible circuit boards 45*a* and 45*b*. A material of the sealing compound 44 is preferably a resin material having some elasticity and high resistance to the ink W, e.g., silicon resin. When the material having elasticity is used for the sealing compound 44, a stress when the partition is deformed can be absorbed so that a breakage or the like of the actuator plate 41 can be prevented.

In addition, in this embodiment, there is a gap between the front end side of the sealing compound 44 and the rear end side of each discharging channel 50 in the length direction, the discharging channels 50 being communicated with each other by the gap. Note that when the oil (nonaqueous) ink W is used as in this embodiment, there is no fear that the electric current leaks through the ink W. Therefore, neighboring discharging channels 50 can be communicated with each other. However, the sealing compound 44 may be filled in to reach the rear end side of each discharging channel 50 so that the individual discharging channels 50 are separated from each other.

(Manufacturing Method for the Head Chip)

Next, a manufacturing method for the above-mentioned head chip 21 is described. Note that a manufacturing method for the piezoelectric actuator 30 is described mainly in the following description. FIGS. 7 and 8 are process views illustrating the manufacturing method for the piezoelectric actuator 30.

Figure 7A:
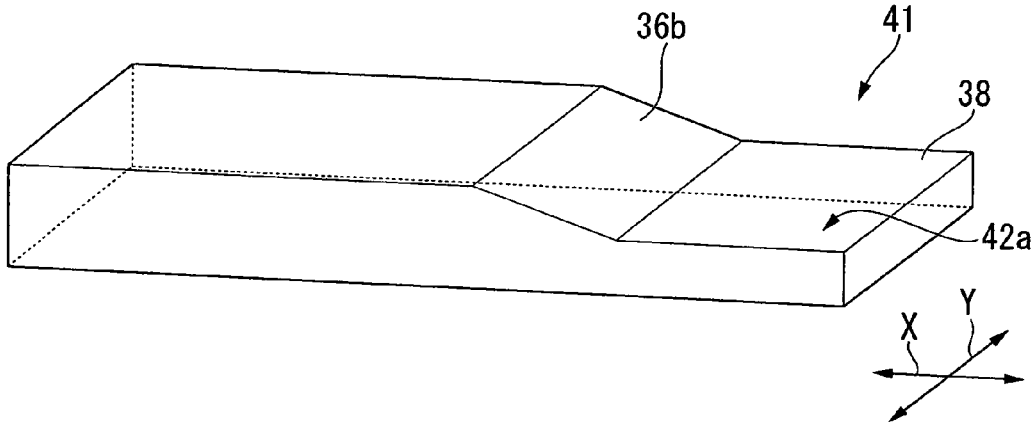
FIGS. 7A to 7C are process views illustrating a manufacturing method for the piezoelectric actuator.

First, as illustrated in FIG. 7A, the actuator plate 41 is ground (grinding step). Specifically, the flat surface 38 is formed on the rear side of the actuator plate 41 in the length direction, and the inclining portion 36*b* is formed from the flat surface 38 to the front side so that the thickness of the actuator plate 41 is gradually decreased.

Figure 7B:
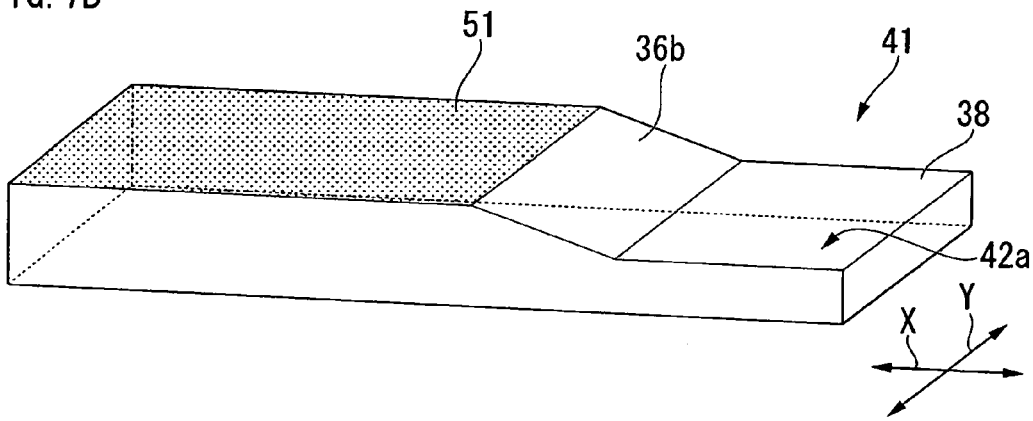

Next, as illustrated in FIG. 7B, a laminate 51 is attached onto the surface 42*a* of the actuator plate 41 on the front side in the length direction (mask formation step). Specifically, film-like resist such as dry film resist is attached first to the region (groove portion 35 forming region) on the surface 42*a* of the actuator plate 41 except for the inclining portion 36*b* and the flat surface 38. Then, using the photolithography technology, the laminate is exposed to light and is developed so that the laminate 51 in the groove portion 35 forming region (see FIGS. 5A and 5B) is removed. Thus, a mask pattern for forming the groove portion 35 is formed on the surface 42*a* of the actuator plate 41. Note that the resist material used for the masking step may be liquid resist or the like instead of the dry film resist. However, when the dry film resist is used as in this embodiment, the thickness of the laminate 51 can be uniform so that the depth of the groove portion 35 can be controlled easily in the dicing step that is described later.

Figure 7C:
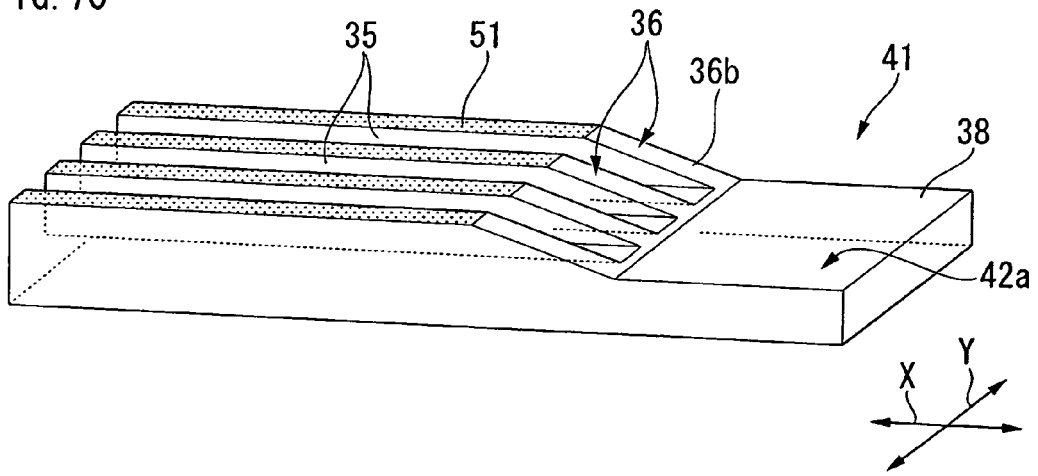

Next, as illustrated in FIG. 7C, the dicing process is performed on the surface 42*a* of the actuator plate 41 so as to form the groove portions 35 (groove portion forming step). Specifically, the diamond blade or other dicer is used for grinding the actuator plate 41 in accordance with the mask pattern of the laminate 51 formed on the actuator plate 41. Thus, the plurality of groove portions 35 can be formed on the surface 42*a* of the actuator plate 41 with the width and the pitch described above, and the partitions 36 for separating the individual groove portions 35 can be formed like comb teeth.

Figure 8A:
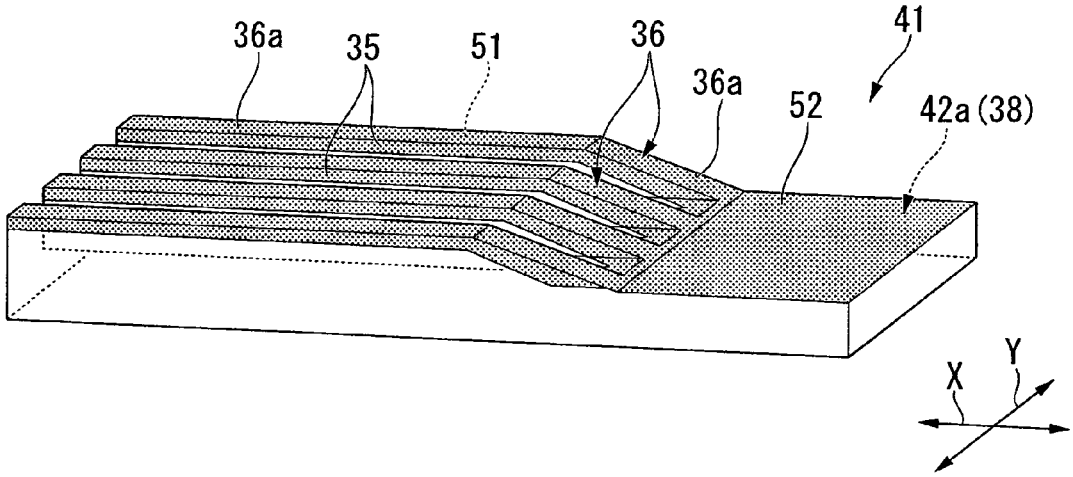
FIGS. 8A to 8C are process views illustrating a manufacturing method for the piezoelectric actuator.

Further, as illustrated in FIG. 8A, an electrode film 52 to be the drive electrode 37 (see FIG. 6) is formed on the surface 42*a* of the actuator plate 41 (electrode film forming step). Specifically, using a known oblique vapor deposition method or the like, a vapor deposition material is scattered in an oblique direction onto the surface 42*a* of the actuator plate 41 so that the electrode film 52 is formed on the upper surface, the upper half of the side surface, and the flat surface 38 of the partition 36. In this case, the electrode film 52 is not formed on the side surface of the front extending portion 36*a* of the partition 36 and the bottom surface 35*a* of the groove portion 35 corresponding to the front extending portion 36*a* (see FIGS. 5A and 5B).

Figure 8B:
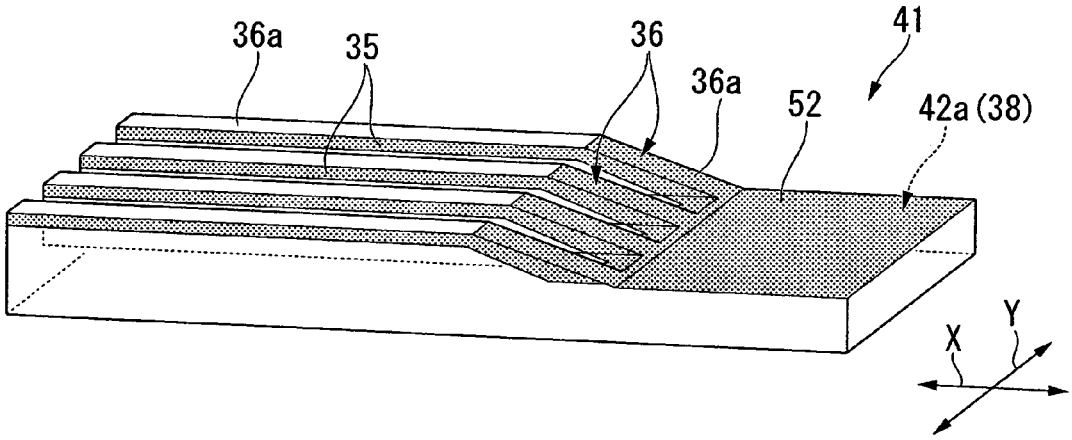

Next, as illustrated in FIG. 8B, the mask pattern of the laminate 51 (see FIG. 7C) attached to the upper surface of the front extending portion 36*a* of the partition 36 is lift off, and is removed together with the electrode film 52 formed on the laminate 51 (lift off step).

Figure 8C:
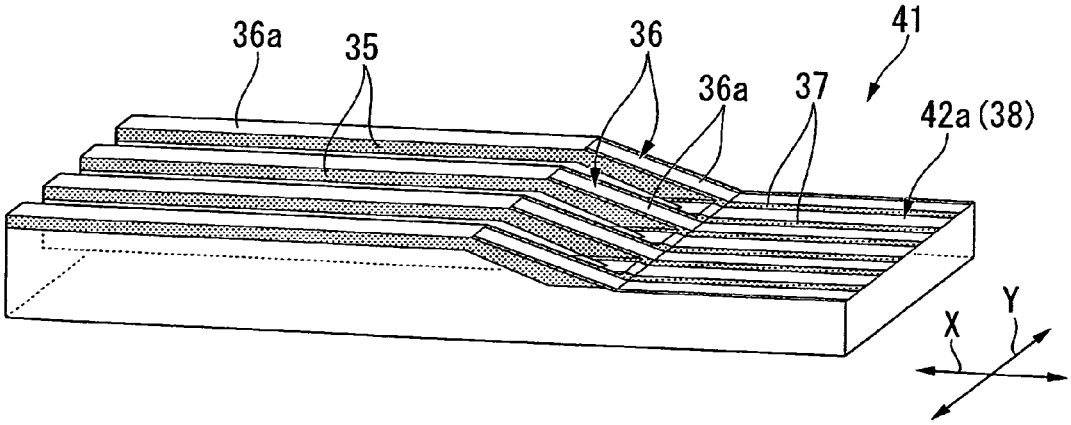

Then, as illustrated in FIG. 8C, the electrode film 52 formed on the surface 42*a* of the actuator plate 41 is divided into the plurality of drive electrodes 37 (trimming step). Specifically, laser trimming is performed along the length direction of the actuator plate on the middle portion of the groove portion 35 in the lateral width direction and on the middle portion of the partition 36 in the lateral width direction so that the electrode film 52 is divided into the plurality of drive electrodes 37 with spaces in the lateral width direction.

Thus, the first actuator plate 41*a* and the second actuator plate 41*b* described above are completed.

After that, as illustrated in FIGS. 5A and 5B, the ink inlet hole 40 communicating between the back surface 42*d* of the second actuator plate 41*b* and the bottom surface 35*a* of the groove portion 35 is formed along the lateral width direction of the second actuator plate 41*b*.

Then, the first actuator plate 41*a* and the second actuator plate 41*b* are adhered to each other with adhesive (adhering step). Specifically, the adhesive is applied to the upper end surfaces of the partitions 36 of both the actuator plates 41*a* and 41*b*, and the actuator plates 41*a* and 41*b* are superimposed with each other so that the partitions 36 of the actuator plates 41*a* and 41*b* are arranged alternately, and the partition 36 of one actuator plate divides the space in the groove portion 35 of the other actuator plate into two parts in the lateral width direction. Here, the width I1 of the groove portion 35 is larger than the width I2 of the partition 36 as described above. Therefore, the partition 36 of the first actuator plate 41*a* can be securely positioned in the groove portion 35 of the second actuator plate 41*b*, while the partition 36 of the second actuator plate 41*b* can be securely positioned in the groove portion 35 of the first actuator plate 41*a*.

Thus, the actuator plates 41*a* and 41*b* are adhered and fixed to each other with adhesive (not shown) applied between the upper end surface of the partition 36 of one actuator plate (e.g., first actuator plate 41*a*) and the bottom surface 35*a* of the groove portion 35 of the other actuator plate (e.g., second actuator plate 41*b*), thereby the piezoelectric actuator 30 is completed.

After that, the piezoelectric actuator 30 is fit in the engaging hole 32*a* of the support plate 32, and the nozzle plate 33 is adhered and fixed to the front end surfaces of the support plate 32 and the piezoelectric actuator 30. On this occasion, the nozzle plate 33 is adhered to the front end surfaces while the nozzle holes 33*a* of the nozzle plate 33 and the discharging channels 50 of the piezoelectric actuator 30 are aligned so as to be communicated with each other.

Thus, the head chip 21 of this embodiment is completed.

(Operating Method for the Inkjet Printer)

Next, a case of using the inkjet printer 1 having the structure described above for printing characters or graphics on the recording paper P is described below. Note that it is supposed that the four ink tanks 39 are adequately filled with the ink W of different colors as an initial state. In addition, the ink W in the ink tank 39 is supplied to the pressure buffer 22*b* through the supplying tube 60. Therefore, a predetermined amount of ink W is supplied to the ink inlet hole 40 of the head chip 21 via the ink connecting tube 22*c* and the channel member 22*a* and is filled in the channel via the slit 31*b*.

In such the initial state, the recording paper P is inserted from the opening part of the casing 5 on the rear side, and the inkjet printer 1 is activated. Then, as illustrated in FIG. 1, the pair of feed-in rollers 15 and the pair of conveying rollers 16 are first rotated so as to convey the recording paper P in the conveying direction L1. In addition, at the same time, the motor 10 rotates the pulley 8 so as to make the carriage belt 9 turn. Thus, the carriage 6 moves in a reciprocating manner in the perpendicular direction L2 with being guided by the guide rail 7.

Then, in this period, the head chips 21 of the individual inkjet heads 2 jet four color ink W appropriately to the recording paper P so that characters or images can be recorded. In particular, the inkjet printer 1 of this embodiment is the shuttle type, and hence recording can be performed correctly in a desired range on the recording paper P.

Here, the operation of each inkjet head 2 is described in detail below.

When the carriage 6 starts the reciprocating movement, the driving circuit 25 applies the drive voltage to the drive electrode 37 via the flexible circuit boards 45*a* and 45*b*. The piezoelectric actuator 30 of this embodiment has one polarization direction of the actuator plate 41, and the side face electrode 37*a* is formed only in the region extending to the middle position on the side surface of the partition 36 in the height direction. Therefore, when the drive voltage is applied, the partition 36 is bent and deformed in a V-shape with the center at the middle position in the height direction. Thus, the volumetric capacity of the discharging channel 50 is increased so that the ink W is led into the discharging channel 50 through the ink inlet hole 40. Then, the drive voltage applied to the drive electrode 37 is made to be zero at the timing when a pressure wave due to the ink W reaches a vicinity of the nozzle hole 33*a*, and the deformation of the partition 36 is reset so that the increased volumetric capacity of the discharging channel 50 is reset to be the original volumetric capacity. By this operation, the pressure inside the discharging channel 50 increases so that the ink W is pressurized. As a result, the ink W is discharged from the discharging channel 50 as being pushed out by the partition 36.

The discharged ink W passes through the nozzle hole 33*a* and is discharged to the outside. Further, the ink W becomes like a drop, i.e., an ink drop when the ink W passes through the nozzle hole 33*a*, and is discharged. As a result, recording can be performed correctly in a desired range on the recording paper P.

In this way, this embodiment has the structure in which the first actuator plate 41*a* and the second actuator plate 41*b* are superimposed with each other so that the partitions 36 thereof are arranged alternately, and the discharging channel 50 in which the ink W is filled is formed between the partition 36 of the first actuator plate 41*a* and the partition 36 of the second actuator plate 41*b*.

With this structure, the partitions 36 of the actuator plates 41*a* and 41*b* are arranged alternately, and hence the partition 36 of one actuator plate divides the space in the groove portion 35 of the other actuator plate into two parts in the width direction. Thus, one groove portion 35 can form two discharging channels 50, and hence the discharging channel 50 having a width smaller than that of the conventional discharging channel 50 can be formed by using the existing machining tools and manufacturing method.

Therefore, the pitch of the discharging channels 50 can be decreased while easiness in machining and yield are improved. Thus, resolution of characters and symbols printed on the recording paper P can be increased so that high resolution can be realized. As a result, high quality of the inkjet printer 1 itself can be realized.

Further, in this embodiment, the actuator plates 41 having the same shape are used so that the actuator plates 41*a* and 41*b* can be manufactured by using the same machining tools and manufacturing method. Therefore, the easiness in machining can be further improved, and manufacturing cost can be reduced.

In addition, the minor axis direction of the nozzle hole 33*a* corresponds to the width direction of the discharging channel 50 so that the nozzle hole 33*a* and the discharging channel 50 are communicated to each other. Therefore, the opening area can be larger than a nozzle hole having a circular shape, for example. Thus, even if the ink W is jet through the discharging channel 50 having a small width, the discharging amount of the ink W can be secured.

Second Embodiment

Figure 9A:
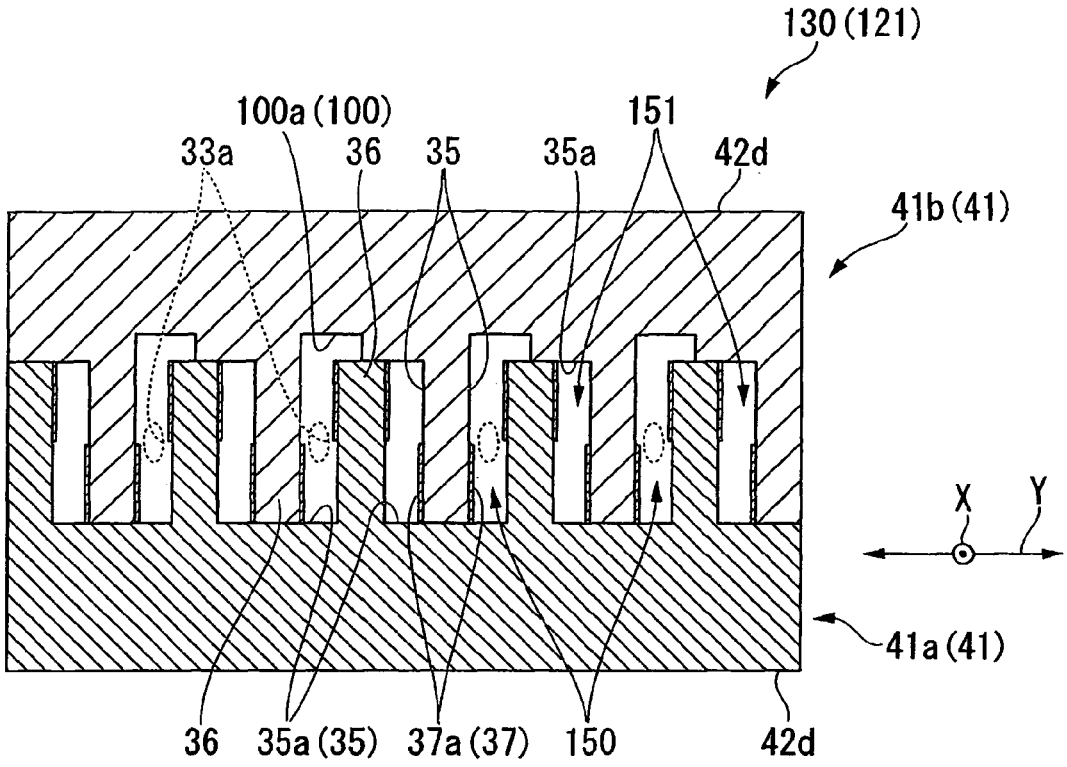
FIGS. 9A and 9B are sectional views of the piezoelectric actuator according to a second embodiment of the present invention.
Figure 9B:
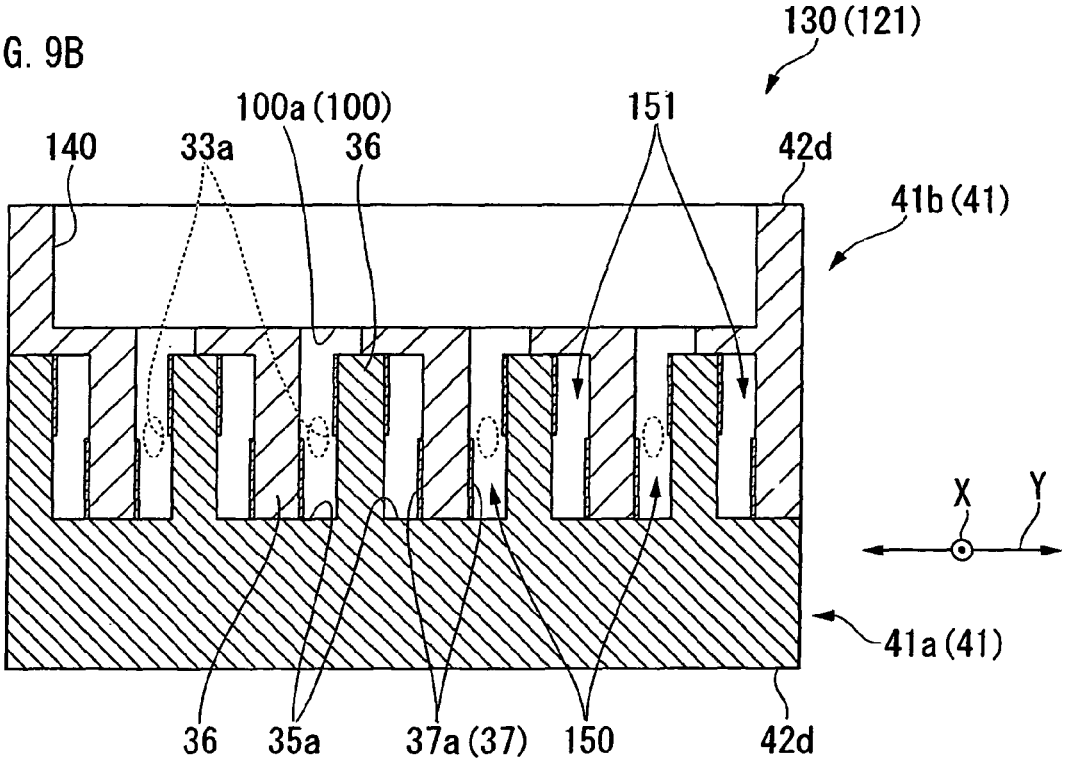

Next, a second embodiment of the present invention is described. FIGS. 9A and 9B are sectional views of a piezoelectric actuator 130 in the second embodiment, which correspond to FIGS. 5A and 5B. Note that the same structure as in the first embodiment described above is denoted by the same reference symbol so that overlapping description is omitted. The inkjet printer of this embodiment has a structure of mainly using conductive aqueous ink for recording.

As illustrated in FIGS. 9A and 9B, the piezoelectric actuator 130 of a head chip 121 according to this embodiment has the groove portion 35 that is divided into two channels. One channel constitutes a discharging channel 150 in which the ink W is filled, while the other channel constitutes a dummy channel 151 in which the ink W is not filled. In other words, the channels of this embodiment include the discharging channels 150 and the dummy channels 151 that are arranged alternately.

A deep groove portion 100 that is ground deeper than the bottom surface 35*a* of the groove portion 35 is formed in the discharging channel 150 of the groove portion 35 of the second actuator plate 41*b*. The deep groove portion 100 is formed after the dicing step described above, by using a dicer having a thickness (blade width) smaller than (approximately a half of) that of the dicer used in the dicing step, and by grinding the region where the discharging channel 150 of the groove portion 35 is formed. Note that the deep groove portion 100 is separated from the dummy channel 151 by the partition 36 of the first actuator plate 41*a*.

Here, the second actuator plate 41*b* is provided with an ink inlet hole 140 communicating only between the back surface 42*d* thereof and a bottom surface 100*a* of the deep groove portion 100. The ink inlet hole 140 is a through hole formed in the lateral width direction of the second actuator plate 41*b* and having a rectangular shape in the plan view. In other words, the ink inlet hole 140 communicates to the discharging channel 150 via the deep groove portion 100 so that the ink W can be filled in the discharging channel 150. In contrast, the ink inlet hole 140 does not communicate to the dummy channel 151, and hence the ink W is not filled in the dummy channel 151.

Therefore, according to this embodiment, in addition to the same effect of the first embodiment described above, the plurality of channels formed by dividing the groove portion 35 work as discharging channels 150 alternately. Therefore, even if conductive aqueous ink W is used, the drive electrode 37 disposed in the discharging channel 150 and the drive electrode 37 disposed in the dummy channel 151 can be used independently in an insulated manner from each other without being conducted through the ink W. Therefore, the aqueous ink W can be used for recording. Thus, the conductive ink W can be used without a problem, and hence additional values of the inkjet printer 1 can be enhanced.

In this case, the deep groove portion 100 is further formed in the groove portion 35 of the second actuator plate 41*b*, and the ink inlet hole 140 that communicates only to the deep groove portion 100 is formed so that the ink W can be filled only in the discharging channel 150. Thus, it is possible to provide the piezoelectric actuator 130 that can support aqueous ink W without increasing machining steps compared with the case of using the oil ink W. Therefore, manufacturing cost and manufacturing efficiency can be maintained.

Third Embodiment

Figure 10:
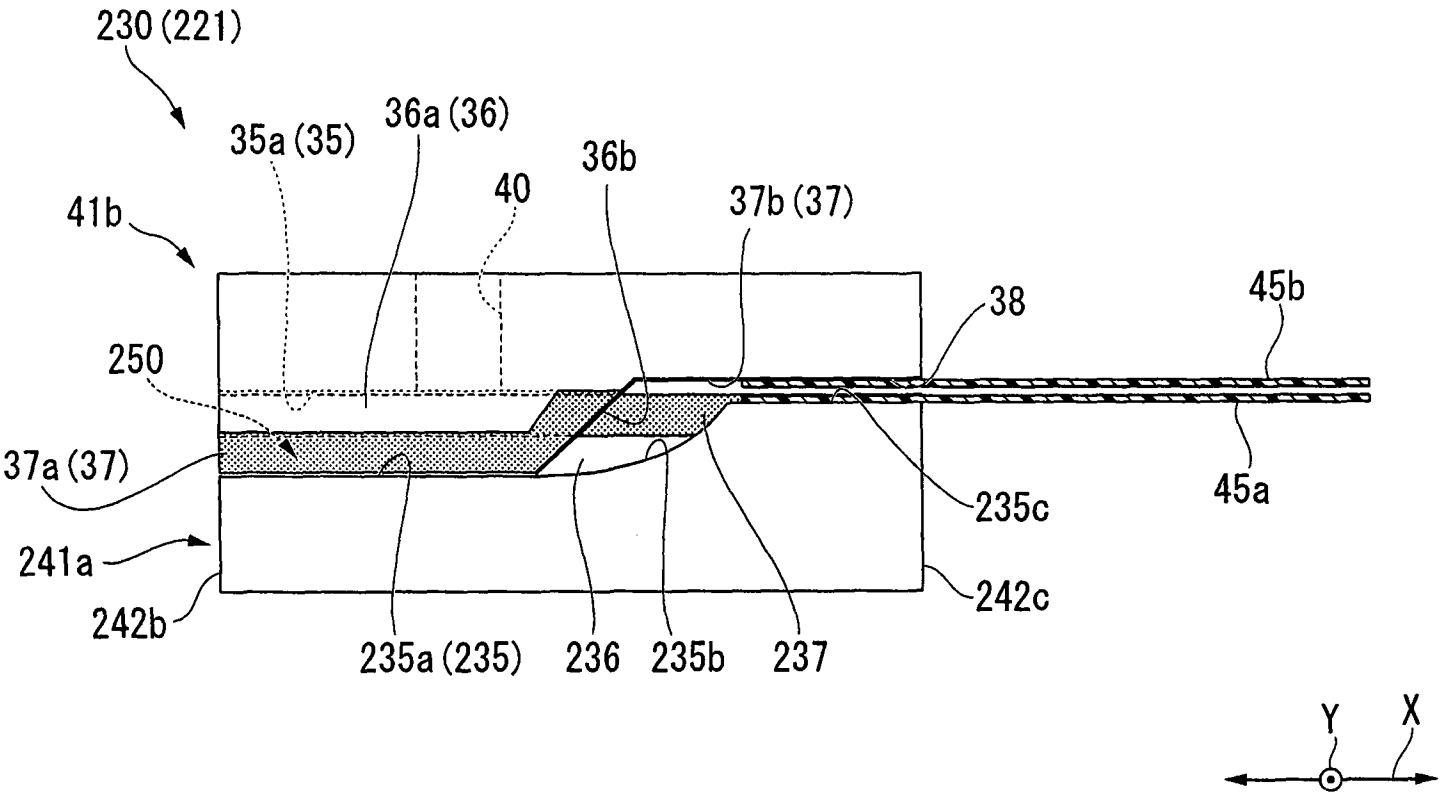
FIG. 10 is a side view of the piezoelectric actuator according to a third embodiment of the present invention.

Next, a third embodiment of the present invention is described. FIG. 10 is a side view of a piezoelectric actuator 230 in the third embodiment. Note that the same structure as in the first embodiment described above is denoted by the same reference symbol so that overlapping description is omitted.

As illustrated in FIG. 10, the piezoelectric actuator 230 of a head chip 221 of this embodiment is different from that of the first embodiment described above concerning a shape of a first actuator plate 241*a*. As illustrated in FIG. 10, the first actuator plate 241*a* is a plate made of a piezoelectric material such as PZT similarly to the first actuator plate 41*a* (see FIG. 4) of the first embodiment described above. A plurality of groove portions 235 extending in the length direction (direction of the arrow X) are formed on the upper surface of the first actuator plate 241*a* and arranged in the lateral width direction (direction of the arrow Y) with predetermined spaces. Further, the plurality of groove portions 235 are separated from each other by a plurality of partitions 236 formed like comb teeth.

The plurality of groove portions 235 are formed so as to have openings on a front end surface 242*b* side of the first actuator plate 241*a* and to have the depth decreasing gradually toward a rear end surface 242*c*. In other words, the bottom surface of each groove portion 235 is constituted of a front flat surface 235*a* extending from the front end surface 242*b* of the first actuator plate 241*a* to substantially the middle portion in the length direction, an inclined surface 235*b* having a groove depth decreasing from the rear end of the front flat surface 235*a* toward the rear side, and a rear flat surface 235*c* extending from the rear end of the inclined surface 235*b* toward the rear side.

On the opening side of the groove portion 235 on each side surface of each partition 236, a drive electrode 237 for applying the drive voltage is formed to extend along the length direction of the first actuator plate 241*a*. The drive electrode 237 is formed by the oblique vapor deposition or the like, and the rear end thereof is connected to the lead electrode (not shown) of the flexible circuit board 45*a*.

Further, the first actuator plate 241*a* and the second actuator plate 41*b* are superimposed with each other so that the rear flat surface 235*c* of the first actuator plate 241*a* and the flat surface 38 of the second actuator plate 41*b* are opposed to each other and that the partitions 236 and 36 of the actuator plates 241*a* and 41*b* are arranged alternately. Thus, the partition 236 or 36 of one actuator plate divides the groove portion 35 or 235 of the other actuator plate into two parts in the lateral width direction. Further, the actuator plates 241*a* and 41*b* are adhered and fixed to each other with adhesive (not shown) applied between the upper end surface of the partition 236 of one actuator plate (e.g., first actuator plate 241*a*) and the bottom surface 35*a* of the groove portion 35 of the other actuator plate (e.g., second actuator plate 41*b*). Thus, the groove portions 235 and 35 divided by the partitions 236 and 36 into two parts each constitute the discharging channel 250 in which the ink W is filled.

According to this embodiment, the first actuator plate 241*a* having the groove portion 235 is simply superimposed with the second actuator plate 41*b* having the same structure as the first embodiment, and thus the same effect as in the first embodiment can be obtained. Therefore, flexibility in design can be improved because different types of actuator plates 241*a* and 41*b* can be combined.

Note that the present invention is not limited to the embodiments described above, which can be modified variously within the scope of the present invention without deviating from the spirit thereof.

For instance, the inkjet printer 1 is exemplified as an example of the liquid jet recording apparatus in the embodiments described above, but the present invention is not limited to the printer. For instance, the present invention can be applied to a facsimile or an on-demand printer.

In addition, in the embodiments described above, there is described the case where the actuator plate 41 having one polarization direction is used, and the drive electrode 37 is formed in the area extending to the middle portion in the height direction of the partition 36 so that the partition 36 can be bent and deformed. However, the polarization direction of the actuator plate may have two directions, i.e., the upward and the downward direction (so-called chevron type). In this case, the drive electrode may be formed on the entire surface of the side surface of the partition, and hence the partition is bent and deformed by the piezoelectric sliding effect in a V-shape with the center at the middle position in the height direction. Therefore, the partition can be deformed with a low voltage.

In addition, widths of the groove portion and the partition of the actuator plate, the pitch of the discharging channels, and the like can be modified in design appropriately if necessary.

In addition, the connecting portions of the first flexible circuit board 45*a* and the second flexible circuit board 45*b* at one end are shifted from each other in the width direction of the IC substrate 26 for connection in the embodiment described above. However, the flexible circuit boards having different lengths may be used so that the connecting portions thereof are shifted from each other in the length direction of the IC substrate 26 for connection.

What is claimed is:

1. A liquid jet head chip, comprising:

a jet plate having a plurality of jet holes for jetting liquid;

a liquid feeding portion comprising first and second actuator plates each having a plurality of partitions spaced apart from one another to form groove portions extending in a direction perpendicular to an arrangement direction of the jet holes, the first and second actuator plates being superimposed relative one another so that the partitions of the first actuator plate extend into the respective groove portions of the second actuator plate and so that the partitions of the second actuator plate extend into the respective groove portions of the first actuator plate to thereby form a plurality of channels communicating with the jet holes for supplying liquid from the channels to the jet holes, first electrodes configured to be driven by a drive voltage applied by a driving circuit and formed on only one of upper half portions and lower half portions of the respective partitions of the first actuator plate, second electrodes configured to be driven by a drive voltage applied by the driving circuit and formed on only the other of the upper half portions and lower half portions of the respective partitions of the second plate, and first and second flexible circuit boards connected to the first and second electrodes, respectively, for electrically connecting the first and second electrodes and the driving circuit to each other; and a sealing compound made of an insulating material and disposed on rear end sides of the first and second actuator plates.

2. A liquid jet head chip according to claim 1; wherein the first actuator plate and the second actuator plate have the same shape.

3. A liquid jet head chip according to claim 2; wherein each of the jet holes has an opening party with an elliptic contour; and wherein the jet holes are arranged so that minor axis directions thereof correspond to short side directions of respective opening parts of the channels.

4. A liquid jet head chip according to claim 3; wherein one of the first actuator plate and the second actuator plate has a liquid inlet hole communicating with the channels so that the liquid can be supplied to the channels.

5. A liquid jet head chip according to claim 4; wherein:

a deep groove portion that is formed deeper than the groove portion is formed in the groove portion of one of the first actuator plate and the second actuator plate on one side in a width direction of the partition of another of the first actuator plate and the second actuator plate; and the liquid inlet hole communicates only with the channel in which the deep groove portion is formed.

6. A liquid jet head, comprising:

the liquid jet head chip according to claim 3;

a supply unit for supplying a predetermined amount of the liquid to a liquid inlet hole of the liquid jet head chip; and a control unit for applying a drive voltage to the first and second electrodes.

7. A liquid jet recording apparatus, comprising:

the liquid jet head according to claim 6;

a conveying unit for conveying a recording medium in a predetermined direction; and a moving unit for moving the liquid jet head in a reciprocating manner in a direction perpendicular to a conveying direction of the recording medium.

8. A liquid jet head, comprising:

the liquid jet head chip according to claim 2;

a supply unit for supplying a predetermined amount of the liquid to a liquid inlet hole of the liquid jet head chip; and a control unit for applying a drive voltage to the first and second electrodes.

9. A liquid jet recording apparatus, comprising:

the liquid jet head according to claim 8;

a conveying unit for conveying a recording medium in a predetermined direction; and a moving unit for moving the liquid jet head in a reciprocating manner in a direction perpendicular to a conveying direction of the recording medium.

10. A liquid jet head chip according to claim 1; wherein each of the jet holes has an opening part with an elliptic contour; and wherein the jet holes are arranged so that minor axis directions thereof correspond to short side directions of respective opening parts of the channels.

11. A liquid jet head chip according to claim 1; wherein one of the first actuator plate and the second actuator plate has a liquid inlet hole communicating with the channels so that the liquid can be supplied to the channels.

12. A liquid jet head chip according to claim 11; wherein:

a deep groove portion that is formed deeper than the groove portion is formed in the groove portion of one of the first actuator plate and the second actuator plate on one side in a width direction of the partition of another of the first actuator plate and the second actuator plate; and the liquid inlet hole communicates only with the channel in which the deep groove portion is formed.

13. A liquid jet head, comprising:

the liquid jet head chip according to claim 1;

a supply unit for supplying a predetermined amount of the liquid to a liquid inlet hole of the liquid jet head chip; and a control unit for applying a drive voltage to the first and second electrodes.

14. A liquid jet recording apparatus, comprising:

the liquid jet head according to claim 13;

a conveying unit for conveying a recording medium in a predetermined direction; and a moving unit for moving the liquid jet head in a reciprocating manner in a direction perpendicular to a conveying direction of the recording medium.

15. A liquid jet head chip according to claim wherein the sealing compound is disposed in a lateral width direction of the first and second actuator plates so as to prevent liquid from leaking from a rear end side of the piezoelectric actuator and to provide insulation between the first and second flexible circuit boards.

16. A liquid jet head chip according to claim 1; wherein the sealing compound comprises a resin material having a flexibility sufficient to enable the absorption of stress generated from deformation of the partitions so as to prevent breakage of the first and second actuator plates.

17. A manufacturing method for a liquid jet head chip comprising:

providing a jet plate having a plurality of jet holes for jetting liquid;

providing a first actuator plate having a plurality of first partitions spaced apart from one another to form first groove portions extending in a direction perpendicular to an arrangement direction of the jet holes;

providing a second actuator plate having a plurality of second partitions spaced apart from one another to form second groove portions extending in a direction perpendicular to an arrangement direction of the jet holes;

forming first electrodes on only one of upper half portions and lower half portions of the respective first partitions of the first actuator plate, the first electrodes being configured to be driven by a drive voltage applied by a driving circuit;

forming second electrodes on only the other of upper half portions and lower half portions of the respective second partitions of the second actuator plate, the second electrodes being configured to be driven by a drive voltage applied by the driving circuit;

connecting first and second flexible circuit boards to the first and second electrodes, respectively, to electrically connect the first and second electrodes and the driving circuit to each other;

providing a sealing compound made of an insulating material; and superimposing the first and second actuator plates relative one another, so that the sealing compound is disposed on rear end sides of the first and second actuator plates, so that the first partitions of the first actuator plate extend into respective second groove portions of the second actuator plate, and so that the second partitions of the second actuator plate extend into respective first groove portions of the first actuator plate to thereby form a liquid feeding portion with a plurality of channels communicating with the jet holes of the jet plate for supplying the liquid from the channels to the jet holes.

18. A method according to claim 17; wherein the first actuator plate and the second actuator plate are formed to have the same shape.

19. A method according to claim 17; wherein the sealing compound is disposed in a lateral width direction of the first and second actuator plates so as to prevent liquid from leaking from a rear end side of the piezoelectric actuator and to provide insulation between the first and second flexible circuit boards.

20. A method according to claim 17; wherein the sealing compound comprises a resin material having a flexibility sufficient to enable the absorption of stress generated from deformation of the partitions so as to prevent breakage of the first and second actuator plates.

21. A liquid jet head chip, comprising:

a jet plate having a plurality of jet holes for jetting liquid;

a piezoelectric actuator having first and second actuator plates superimposed over one another to form a plurality of channels communicating with the jet holes of the jet plate for supplying the liquid from the channels to the jet holes, the first actuator plate having a plurality of first partitions spaced apart from one another to form first groove portions extending in a direction perpendicular to an arrangement direction of the jet holes and having first electrodes each disposed on only a portion of a side surface of a respective one of the first partitions and configured to be driven by a drive voltage applied by a driving circuit, the second actuator plate having a plurality of second partitions spaced apart from one another to form second groove portions extending in a direction perpendicular to an arrangement direction of the jet holes and having second electrodes each disposed on only a portion of a side surface of a respective one of the second partitions and configured to be driven by a drive voltage applied by the driving circuit, the first partitions of the first actuator plate extending into respective second groove portions of the second actuator plate and the second partitions of the second actuator plate extending into respective first groove portions of the first actuator plate to form the channels communicating with the jet holes, first and second flexible circuit boards connected to the first and second electrodes, respectively, for electrically connecting the first and second electrodes and the driving circuit to each; and a sealing compound made of an insulating material and disposed on rear end sides of the first and second actuator plates.

22. A liquid jet head, comprising:

the liquid jet head chip according to claim 21;

a supply unit for supplying a predetermined amount of the liquid to a liquid inlet hole of the liquid jet head chip; and a control unit for applying a drive voltage to the first and second electrodes.

23. A liquid jet recording apparatus, comprising:

the liquid jet head according to claim 22;

a conveying unit for conveying a recording medium in a predetermined direction; and a moving unit for moving the liquid jet head in a reciprocating manner in a direction perpendicular to a conveying direction of the recording medium.

24. A liquid jet head chip according to claim 21;

wherein the sealing compound is disposed in a lateral width direction of the first and second actuator plates so as to prevent liquid from leaking from a rear end side of the piezoelectric actuator and to provide insulation between the first and second flexible circuit boards.

25. A liquid jet head chip according to claim 21; wherein the sealing compound comprises a resin material having a flexibility sufficient to enable the absorption of stress generated from deformation of the partitions so as to prevent breakage of the first and second actuator plates.

* * * * *